United States Patent [19]

Cenna, III

[11] 4,321,874

[45] Mar. 30, 1982

[54] MUSIC STAND

[76] Inventor: John J. Cenna, III, 332 Dunbar Dr., Pittsburgh, Pa. 15235

[21] Appl. No.: 115,934

[22] Filed: Jan. 28, 1980

[51] Int. Cl.[3] ..... G10G 5/00; A47B 43/00

[52] U.S. Cl. ..... 108/99; 84/453; 108/92; 182/132; 211/182; 248/164

[58] Field of Search ..... 108/92, 99, 100, 101; 248/164, 432; 312/196, 277; 211/182; 84/170, 453, 421, 327; 182/132

[56] References Cited

U.S. PATENT DOCUMENTS

| | | | |
|---|---|---|---|
| 769,354 | 9/1904 | Nielsen | 182/132 X |
| 890,311 | 6/1908 | Stockham | 108/92 |
| 2,502,752 | 4/1950 | Richards | 5/507 X |
| 2,673,671 | 3/1954 | Williams | 108/92 |
| 2,722,860 | 11/1955 | Pace | 84/170 X |
| 2,739,849 | 3/1956 | Lynn | 182/132 |
| 2,775,488 | 12/1956 | Wingrove | 182/132 X |
| 2,901,123 | 8/1959 | Johnson | 108/100 |
| 2,965,241 | 12/1960 | Derman | 108/101 |
| 3,101,022 | 8/1963 | Baschet . | |
| 3,280,939 | 10/1966 | Smith | 182/132 X |
| 3,392,801 | 7/1968 | Gethmann | 182/132 |
| 3,433,115 | 3/1969 | Kjestrom . | |
| 3,462,773 | 8/1969 | Triplett | 108/115 |
| 3,893,363 | 7/1975 | Cohen . | |
| 3,945,291 | 3/1976 | Zickos | 84/421 |
| 4,065,994 | 1/1978 | Streit | 84/387 A |

FOREIGN PATENT DOCUMENTS

| | | | |
|---|---|---|---|
| 489906 | 8/1977 | Australia | 108/99 |
| 851610 | 9/1970 | Canada | 108/92 |
| 1156416 | 5/1958 | France | 108/99 |
| 1222783 | 6/1960 | France | 108/99 |
| 466632 | 1/1937 | United Kingdom | 84/421 |
| 985912 | 3/1965 | United Kingdom | 182/132 |
| 1218950 | 1/1971 | United Kingdom | 108/99 |

*Primary Examiner*—James T. McCall

*Attorney, Agent, or Firm*—Stanley J. Price, Jr.; John M. Adams

[57] ABSTRACT

A collapsible frame includes a plurality of legs adapted to engage a floor. The legs are connected by braces to rigidify the legs in an upstanding position. A plurality of arms are connected to the legs to form a plurality of vertically spaced support platforms. Each support platform is formed by a pair of the arms positioned in spaced parallel, horizontal relationship. The pairs of arms are located at selected elevations to provide upper and lower support platforms with at least one intermediate support platform between the upper and lower support platforms. The legs are suitably connected to facilitate assembly and disassembly of the music stand for storage and transportation. The support platforms are adapted to support musical instruments and related accessories, such as percussion instruments, for movement on the music stand to permit the instruments to be placed in selected positions and combinations for playing by the musician.

9 Claims, 4 Drawing Figures

MUSIC STAND

BACKGROUND OF THE INVENTION

1. Field of the Invention

This invention relates to a music stand for supporting musical instruments and instrument accessories and more particularly to a collapsible music stand that includes a plurality of support platforms positioned at selected elevations to support the instruments and accessories for movement on the stand into desired positions and combinations for playing a musical piece.

2. Description of the Prior Art

Stands for supporting musical instruments and particularly percussion instruments are well known in the art. The known stands are adaptable to support various types of percussion instruments in a desired number and arrangement as determined by the musical piece to be preformed. An example of such a percussion instrument stand is disclosed in U.S. Pat. No. 3,893,363. There a plurality of rods are attached to a central stand having a tripod base. Each rod includes an externally threaded end portion of a diameter to pass through apertures in a mounting bar. The opposite end portion of the rod is internally threaded to receive the externally threaded end portion of another rod. With this arrangement, a plurality of rods are attached to each other and the mounting bar in various arrangements for supporting percussion instruments. The percussion instruments are rigidly clamped to the rods by suitable fasteners so that the instruments are fixed in a selected position on the stand.

U.S. Pat. Nos. 3,945,291; 3,433,115; and 3,101,022 disclose stands for supporting percussion instruments, particularly drums, on elongated members that are interconnected by various joints to a central frame. With each of these stands the instruments are connected by rods, fasteners, and the like to the music stand. Therefore, in order to raplace the instruments on the stand or move the instruments to selected positions on the stand, the instruments must be disconnected and mechanically reassembled on the stand.

The prior art devices do not permit the instruments to be readily movable on the stand nor removed from the stand without disengaging the instruments from mechanical connection to the stand. Therefore, there is need for a music stand that freely supports a plurality of instruments for movement into selected positions and combinations on the stand.

SUMMARY OF THE INVENTION

In accordance with the present invention there is provided a music stand for supporting musical instruments and instrument accessories that includes a frame having a plurality of leg members adapted to engage a floor. The leg members extend upwardly from the floor. Brace members are connected to and extend between the leg members to rigidify the leg members in an upstanding position on the floor. A plurality of arm members are connected to the leg members to form a plurality of support platforms. The support paltforms are positioned one above the other and spaced vertically a preselected distance apart. The support platforms are positioned to receive selected musical instruments and instrument accessories in a predetermined arrangement.

The arm members are positioned in spaced relation to form an upper support platform and a lower support platform with an intermediate support platform positioned therebetween. The upper, lower and intermediate support platforms are vertically spaced to provide access to the musical instruments and instrument accessories positioned thereon.

In one embodiment the leg members include a first pair of connected legs and a second pair of connected legs. The first pair of legs are pivotally connected to the second pair of legs respectively. The first and second pairs of legs are pivotal in a first direction toward each other to collapse the frame. Also, the first and second pairs of legs are pivotal in a second direction to erect the frame, and means is provided for maintaining the frame erect.

A flexible member, such as cloth or a length of chain, extends between the first and second pairs of legs to connect the pairs of legs for movement in the first and second directions. The flexible member is operable to limit the pivotal movement of the first and second pairs of legs in the second direction to a position where the frame is erect for supporting the desired musical instruments an instrument accessories. With this arrangement when the first and second pairs of legs are spread apart they will pivot to the point where the flexible member is fully extended to prevent further pivotal movement of the legs. Thus, the legs are supported a desired pivoted distance apart for supporting the musical instruments.

The support platforms preferably include a plurality of pairs of arm members positioned in horizontal parallel, spaced relation. A first pair of arm members is supported by the frame at an upper level. A second pair of arm members is supported by the frame at a lower level below the first pair of arm members. At least a third pair of arm members are supported by the frame at a level intermediate the first and second pairs of arm members. With this arrangement, various musical instruments and instrument accessories can be positioned on the platforms at elevations which are readily accessible to the musician. Also, the music stand of the present invention is useful as an accessory stand to make available to the musician accessories to be used in playing various instruments such as percussion instruments.

A further feature of the present invention includes a shelf positioned on each of the first, second and third pairs of the elevated arm members. The shelves are vertically displaced to provide a plurality of levels for supporting musical instruments and instrument accessories in preselected positions and combinations.

Accordingly, the principal object of the present invention is to provide a music stand that supports musical instruments and instrument accessories in preselected positions which are readily accessible to the musician for playing the instruments.

Another object of the present invention is to provide a music stand that is readily collapsible to facilitate efficient assembly, disassembly, transportation and storage of the music stand.

A further object of the present invention is to provide a collapsible music stand that includes a plurality of platforms positioned in spaced vertical relationship and adaptable to support a number of instruments and instrument accessories in various combinations and arragements for playing a piece where the instruments and instrument accessories are freely movable on the music stand.

These and other objects of the present invention will be more completely disclosed and described in the following specification, the accompanying drawings and the apended claims.

DESCRIPTION OF THE PREFERRED EMBODIMENTS

Figure 1:
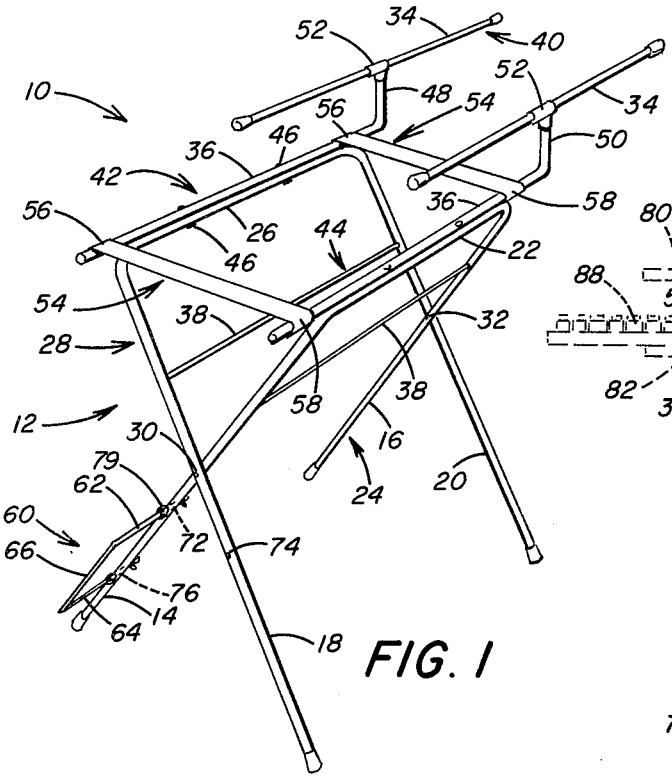
FIG. 1 is an isometric view of one embodiment of the music stand of the present invention, illustrating a plurality of vertically spaced platforms for supporting musical instruments in preselected positions.
Figure 3:
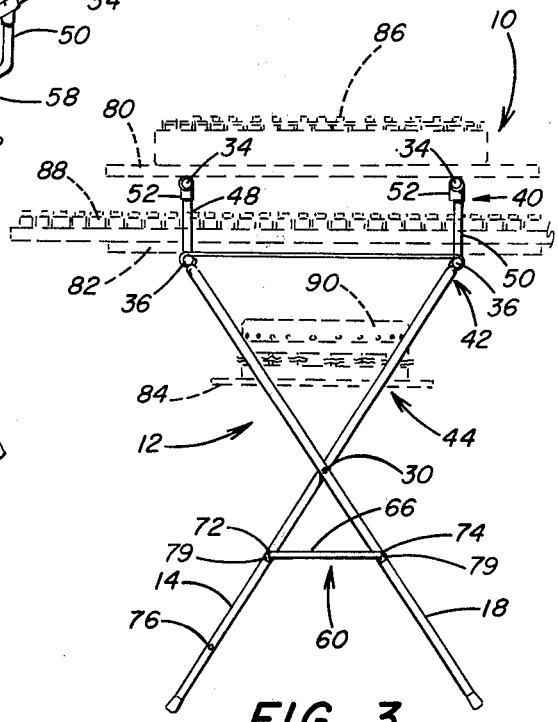
FIG. 3 is a front view of the music stand shown in FIG. 1, illustrating a bar extending between and connected to the front legs of the stand to rigidify the stand in an erect position to support on the stand musical instruments shown in phantom.
Figure 2:
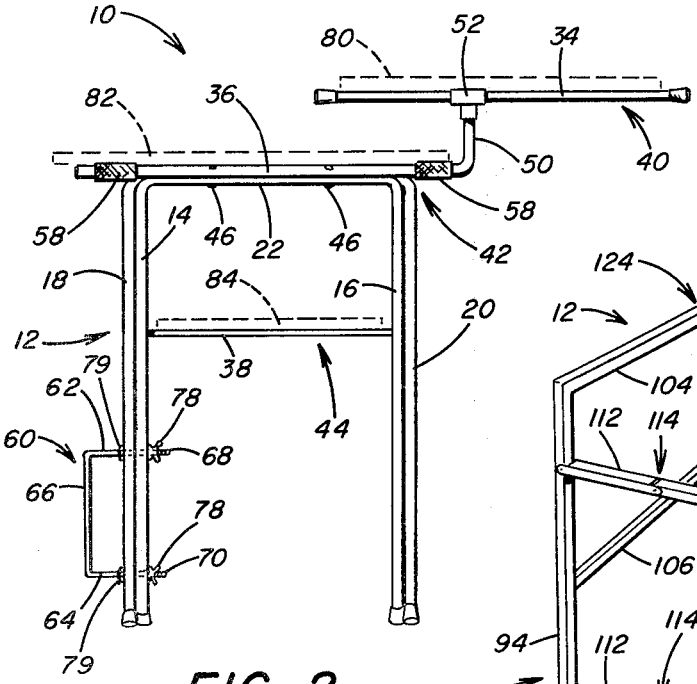
FIG. 2 is a view in side elevation of the music stand shown in FIG. 1, illustrating in phantom shelves positioned on the vertically spaced platforms for supporting musical instruments and instrument accessories.

Referring to the drawings and particularly to FIGS. 1–3, there is illustrated a music stand generally designated by the numeral 10 operable for supporting a plurality of instruments, such as percussion instruments illustrated in phantom in FIG. 3, in various arrangements and combinations which are readily accessible to the musician. The music stand 10 is formed by a collapsible frame generally designated by the numeral 12 that includes a plurality of leg members 14, 16, 18 and 20. In the embodiment of the present invention illustrated in FIG. 1, the leg members 14 and 16 are connected by a transverse bar 22 to form a first pair of legs generally designated by the numeral 24. Similarly, the legs 18 and 20 are connected by transverse bar 26 to form a second pair of leg members generally designated by the numeral 28.

The first pair of legs 24 are positioned within the second pair of legs 28 whereby the leg member 14 abuts the leg member 18 and the leg member 16 abuts the leg member 18. The respective pairs of abutting leg members 14, 18 and 16, 20 are provided with aligned bores (not shown). The bores are arranged to receive connecting pins 30 and 32. The pin 30 pivotally connects leg members 14 and 18, and the pin 32 pivotally connects leg members 16 and 20. With this arrangement the first and second pair of legs 24 and 28 are pivotal between a collapsed position and an erect position. The music stand 10 is shown in an erect position in FIGS. 1–3. Thus, with this arrangement, in order to move the frame 12 from an erect position to a collapsed position, the transverse bars 22 and 26 are urged toward one another into substantially abutting relation. This moves the pair of legs 14, 18 and 16, 20 toward one another from a displaced position to a substantially vertical and closely adjacent position.

Further, in accordance with the present invention, the frame 12 includes a plurality of pairs of arm members 34, 36, and 38 arranged at various elevations and particularly in horizontal, parallel spaced relationship to form a plurality of support platforms 40, 42, and 44. This arrangement permits musical instruments and instrument accessories to be movably supported at different elevations on the music stand 10. The instruments therefore are not immovably secured to the music stand 10 and are free to be moved to desired positions in various combinations which are readily accessible to the musician. The pairs of arms 34–38 are connected to the leg members 14–20 at various levels so that the support platforms 40–44 are positioned one above the other and spaced vertically a preselected distance apart.

As illustrated in FIGS. 1 and 2, the pairs of arms 38 that form the support platform 44 are connected to the leg members 14–20 adjacent the point where the leg members are pivotally connected by the pins 30 and 32. In this position, the support platform 44 is located at a lowermost level on the music stand 10. The pair of arms 36 of the support platform 42 are connected by suitable fasteners 46 to the transverse bars 22 and 26 of the respective pairs of legs 24 and 28. While the pair of arms 36 are illustrated as being connected to the transverse bars 22 and 26, it should also be understood that the support platform 42 may be formed by a pair of arms which are integral with the first and second pairs of legs 24 and 28 rather than by connecting the pair of arms 36 to the tranverse bars 22 and 26. Thus, the support platform 42 forms an intermediate support platform positioned between the support platform 40 and the support platform 44.

The support platform 40 is positioned at an uppermost level on the music stand 10 to thereby form an upper support platform for receiving and supporting a musical instrument on the pair of arms 34. The support platform 40 is also connected to the first and second pairs of legs 24 and 28 by upstanding members 48 and 50 that are formed integral with the pair of arms 36. The members 48 and 50 extend upwardly from the pair of arms 36 at the forward end portions thereof. The upper ends of the upstanding members 48 and 50 are suitably connected to T-shaped sleeves 52 which receive in a secure manner the pair of support arms 34. Any other suitable connection can be utilized for connecting the pair of arms 34 to the upstanding members 48 and 50.

The T-shaped sleeves 52 are positioned substantially intermediate the end portions of the pair of arms 34 so that the support platform 40 formed by the pair of arms 34 is positioned at an upper level forwardly of the intermediate support platform 42 and the lower support platform 44. Thus, with this arrangement, the intermediate and lower support platforms 42 and 44 are positioned in overlying, spaced parallel relation; while, the upper support platform 40 is positioned in spaced overlying parallel relation with the platforms 42 and 44 and extends forwardly of the platforms 42 and 44. Thus, the support platforms 42 and 44 are efficiently accessible below the support platform 40.

By pivotally connecting the first and second pairs of legs 24 and 28 by the pins 30 and 32, as above described, the music stand 10 is collapsible to facilitate transportation and storage of the stand 10 when not in use. Accordingly, in order to rigidify the music stand 10 in an erect position as illustrated in FIGS. 1–3, a flexible member generally designated by the numeral 54 connect the pair of legs 24 and 28. The flexible members 54 are operable to restrain further pivotal movement of the pair of legs 24 and 28 when the pair of legs 24 and 28 are spaced a preselected distance apart as illustrated in FIGS. 1 and 3 to erect the music stand 10.

The flexible members 54 may include in one embodiment as illustrated in FIGS. 1–3, a web of material, such as plastic, leather, nylon, cloth or the like, secured at ends 56 and 58 of the flexible members 54 to the respective ends of the arm members 36 of the intermediate support platform 42. With this arrangement the pairs of legs 24 and 28 are free to pivot away from one another until the flexible members 54 are fully extended in a substantially horizontal plane. In this pivoted position of the pairs of legs 24 and 28 further pivotal movement of the pairs of legs 24 and 28 is restrained. In the erect position of the music stand 10 the pairs of arms 34, 36, and 38 are spaced a preselected distance apart to form the respective support platforms 40, 42, and 44.

The music stand 10 is maintained in the erect position, as illustrated in FIG. 3, by a brace generally designated by the numeral 60. The brace 60 connects the leg members 14 and 18 in a position where the leg members are spaced a preselected distance apart to maintain the music stand 10 in the erect position. In FIG. 3, the brace 60 is shown in an operative position connected to the legs 14 and 18, and in FIG. 1 the brace 60 is shown in a stored position on the leg member 14 to permit collapsing of the music stand 10. In the stored position of the brace 60, the pairs of legs 24 and 28 are freely pivotal to permit erecting and collapsing of the music stand 10.

As illustrated in FIGS. 1 and 2, the brace 60 is a substantially U-shaped member than includes a pair of end portions 62 and 64 which are connected to a bar 66 where the end portions 62 and 64 extend substantially perpendicular from the bar 66 and are formed integral therewith. The end portions 62 and 64 are preferably threaded at their outer ends 68 and 70, respectively. As shown in FIGS. 1 and 3, the leg members 14 and 18 are provided with apertures 72 and 74 respectively. The apertures 72 and 74 are preferably positioned the same distance from the pivot pin 30 connecting the leg members 14 and 18. In addition, the leg member 14 includes a lower aperture 76 spaced the length of the bar 66 from the aperture 72 in the leg member 14.

When it is desired to collapse the music stand 10 for storage or transportation, the brace 60 is stored on the leg member 14 as illustrated in FIGS. 1 and 2. In the stored position of the brace 60, the end portions 62 and 64 extend through the apertures 72 and 76. Wing nuts 78 are threaded onto the threaded outer ends 68 and 70 to thereby secure the brace 60 in a stored position on the leg member 14.

Accordingly, when it is desired to erect the music stand frame 10 in a position for supporting musical instruments, as illustrated in FIG. 3, the end portion 64 of the brace 60 is removed from the aperture 76 by disengaging the wing nut 78 from the threaded outer end 70 and then inserting the end portion 64 through the aperture 74 of leg member 18. In order to facilitate the insertion of the brace end portion 64 through the aperture 74 the leg members 14 and 18 are pivoted to space the apertures 72 and 74 a distance apart equal to the length of the bar 66 of the brace 60. Once the leg members 14 and 18 have been spread this distance apart, the end portion 64 is then inserted through the aperture 74 and is secured therein by threadedly engaging the wing nut 78 onto the threaded outer end 70 of the end portion 64. Also nuts 79 may be threaded onto the brace end portions 62 and 64 to further secure the brace 60 to the pivoted leg members 14 and 18. It should be also understood that the length of the bar 66 of the brace 60 may be selected to space the leg members 14 and 18 a preselected distance apart corresponding to the desired width between the pairs of arms 34, 36, and 38 that form the support platforms 40, 42, and 44.

When the music stand 10 is in the erect position as illustrated in FIG. 1, the support platforms 40, 42, and 44 are adaptable to support musical instruments and/or instrument accessories in various combinations and arrangements. In one arrangement, musical instruments, such as percussion instruments shown in FIG. 3 may be positioned on the platforms 40, 42, and 44. The instruments are securely supported by the music stand 10 but are freely movable on the music stand to provide the musician with the ability to efficiently move the instruments and instrument accessories to a desired position on the stand and in various combinations as determined by the piece to be played. Thus, in order to change the combination and position of the instruments and accessories on the music stand 10, the musician is not inconvenienced by having to connect and disconnect the instruments and accessories to the stand as required by conventional music stands.

Further, in accordance with the present invention, as illustrated in FIGS. 2 and 3, the support platforms 40, 42, and 44 are utilized to support a plurality of shelves 80, 82 and 84, as shown in phantom in FIGS. 2 and 3. Each of the shelves may include a unitary member such as a board or the like having a preselected length as illustrated in FIG. 2 and a width at least slightly greater than the distance separating the respective pairs of arms 34, 36, and 38. With this arrangement the shelf 80 is supported by the upper support platform 40, the shelf 82 supported by the intermediate support platform 42 and the shelf 84 supported by the lower support platform 44.

Use of the shelves 80, 82, and 84 is particularly adaptable for supporting a number of percussion instruments, such as a pair of xylophones 86 and 88 on the upper support platform 40 and 42. The relative spacing between the intermediate support platform 42 and the upper support platform 40 facilitates positioning of percussion instruments such as the xylophones 86 and 88 for playing the instruments in combination where both instruments are readily accessible to the musician. Further, an additional instrument such as a tambourine 90, as shown in FIG. 3, may be positioned on the shelf 84 supported by the lower support platform 44. With this arrangement, the tambourine 90 is positioned for convenient access and is readily removed from the shelf 84 for playing.

The lower shelf 84 on the lower support platform 44 is also adaptable for storing musical tools or other instrument accessories when not in use, for example wooden hammers for playing the xylophones 86 and 88 and other hand held percussion instruments. Thus, the music stand 10 of the present invention provides a plurality of tiers or levels for supporting a number of musical instruments and instrument accessories in an efficiently accessible arrangement which permits their movement on each level and change of position from one level to another without requiring the instruments and accessories to be immovably connected to the music stand and disconnected in order to move the instruments and accessories on the music stand.

Figure 4:
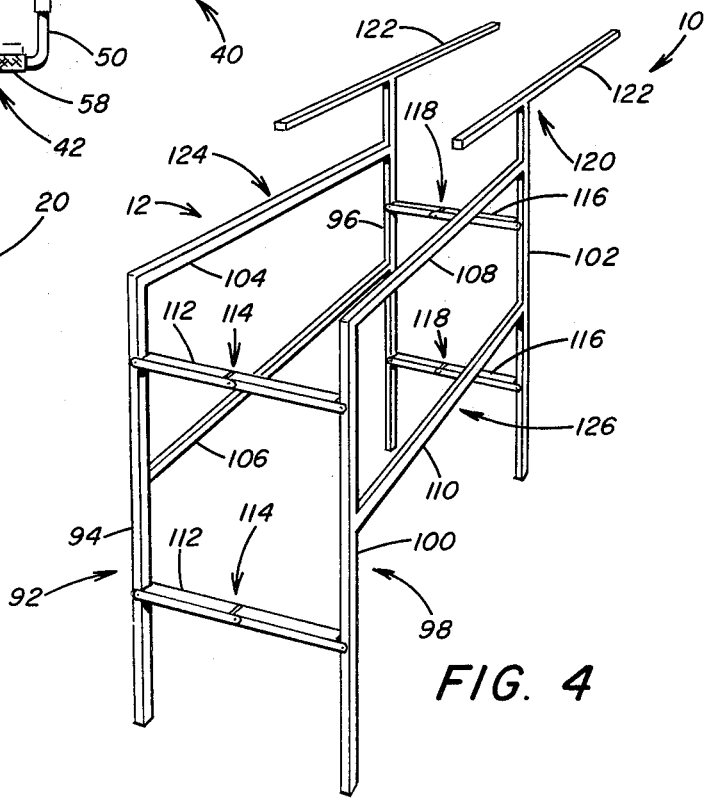
FIG. 4 is a perspective view similar to FIG. 1 of another embodiment of the music stand of the present invention, illustrating rectangularly shaped legs of the music stand frame connected by hinged horizontal braces.

Now referring to FIG. 4, there is illustrated another embodiment of the collapsible frame 12 forming the music stand 10 of the present invention that also includes a first pair 92 of rectangularly constructed leg members 94 and 96 and a second pair 98 of rectangularly constructed leg members 100 and 102. The leg members 94 and 96 of the first pair 92 are spaced apart a preselected parallel distance by brace members 104 and 106. Similarly, the leg members 100 and 102 of the pair 98 are spaced a preselected parallel distance apart by brace members 108 and 110.

The brace members 104–110 may be formed integrally with the respective leg members 94, 96, 100, and 102 or suitably connected thereto. Further, the leg members 94, 96, 100, and 102, as well as, the brace members 104–110 may be constructed of any suitable material, such as metal or wood in any desired cross section. For example, the music stand 10 illustrated in FIGS. 1–3 may be formed of metallic tubular members and the music stand 10 in FIG. 4 formed of rectangular wooden members.

In addition, the leg member 94 is spaced from the leg member 100 a preselected distance by a pair of brace members 112 that are suitably connected at their end portions to the leg members 94 and 100. Each brace member 112 is hinged intermediate its end portions by a hinge generally designated by the numeral 114 to facilitate collapse of the music stand 10. Similarly, the leg members 96 and 102 are connected and spaced a preselected distance apart equal to the spacing between legs 94 and 100 by a pair of brace members 116. The brace members 116 are also hinged intermediate their end portions by hinges 118. With this arrangement, the pairs of brace members 112 and 116 connect the pairs of leg members 92 and 98 to permit the collapse of the music stand 10.

The music stand 10, illustrated in FIG. 4, also includes a plurality of support platforms connected to the pairs of leg members 92 and 98. To this end there is provided an upper support platform generally designated by the numeral 120 that includes a pair of parallel spaced arms 122 connected to the upper ends of leg members 96 and 102. Positioned below the upper support platform 120 is an intermediate support platform generally designated by the numeral 124 that is formed by the brace members 104 and 108. A portion of the intermediate support platform 124 is positioned beneath the arms 122 of the upper support platform 120 and also extends rearwardly from the upper support platform 120.

Positioned in spaced underlying relationship with the intermediate support platform 124 is a lower support platform 126 that is formed by the brace members 106 and 110. The lower support platform extends substantially the length of the intermediate support platform 124. Thus, with this arrangement, a plurality of support platforms 120, 124, and 126 are provided on the music stand 10 of FIG. 4 that permits the musician to movably position a plurality of musical instruments and/or instrument accessories in a preselected arrangement and in a preselected combination for playing a musical piece. Also as above discussed, by supporting musical instruments in this manner, the instruments are readily accessible on the music stand 10 without being immovably connected to the music stand.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A music stand for supporting musical instruments and instrument accessories comprising, a frame including a plurality of leg members adapted to engage a floor and extend upwardly from the floor, said leg members being pivotally connected to permit movement of said leg members between a collapsed position and an erect position, a plurality of pairs of arm members connected to said respective leg members to form a plurality of support platforms, said pairs of arm members being movable with said leg members for movement between a position for supporting musical instruments when said leg members are erect and a collapsed position corresponding to the collapsed position of said leg members, said support platforms being positioned one above the other and spaced vertically a preselected distance apart, flexible means attached to said arm members of at least one of said support platforms for maintaining said frame in an erect position, a brace member of a preselected length adapted to move into and out of position extending between and connecting said leg members to rigidify said leg members in an erect position, and said brace member being operable to rigidify said leg members in an erect position so that said respective pairs of arm members are spaced a preselected distance apart to position said support platforms to receive selected musical instruments and instrument accessories in a predetermined arrangement for playing of said instruments on the stand and to permit freedom of movement of said instruments to selected positions on the stand.

2. A music stand as set forth in claim 1 in which, said arm members are positioned in spaced relation to form an upper support platform and a lower support platform with an intermediate support platform positioned therebetween, and said upper, lower, and intermediate support platforms being vertically spaced to provide access to the musical instruments and instrument accessories.

3. A music stand as set forth in claim 1 in which, said pairs of arm members are positioned in spaced overlying relationship to form an upper support platform and a lower support platform with at least one intermediate support platform between said upper and lower support platforms.

4. A music stand for supporting musical instruments and instrument accessories comprising, a frame including a plurality of leg members adapted to engage a floor and extend upwardly from the floor, said leg members being pivotally connected to permit movement of said leg members between a collapsed position and an erect position, said leg members include a first pair of connected legs and a second pair of connected legs, said first pair of legs being pivotally connected to said second pair of legs respectively, said first and second pairs of legs being pivotal in a first direction toward each other to collapse said frame, said first and second pairs of legs being pivotal in a second direction away from each other to erect said frame, a plurality of pairs of arm members connected to said respective leg members to form a plurality of support platforms, said pairs of arm members being movable with said leg members for movement between a position for supporting musical instruments when said leg members are erect and a collapsed position corresponding to the collapsed position of said leg members, said support platforms being positioned one above the other and spaced vertically a preselected distance apart, a brace member of a preselected length adapted to move into and out of position extending between and connecting said leg members to rigidify said leg members in an erect position, and said brace member being operable to rigidify said leg members in an erect position so that said respective pairs of arm members are spaced a preselected distance apart to position said support platforms to receive selected musical instruments and instrument accessories in a predetermined arrangement for playing of said instruments on the stand and to permit freedom of movement of said instruments to selected positions on the stand.

5. A music stand as set forth in claim 4 which includes, flexible means extending between said first and second pairs of legs to connect said pairs of legs for movement thereof in said first and second directions, and said flexible means being operable to limit pivotal movement of said first and second pairs of legs in said second direction to a preselected distance apart.

6. A music stand for supporting musical instruments and instrument accessories comprising, a frame including a plurality of leg members adapted to engage a floor and extend upwardly from the floor, said leg members being pivotally connected to permit movement of said leg members between a collapsed position and an erect position, a plurality of pairs of arm members connected to said respective leg members to form a plurality of support platforms, said pairs of arm members being movable with said leg members for movement between a position for supporting musical instruments when said leg members are erect and a collapsed position corresponding to the collapsed position of said leg members, said support platforms being positioned one above the other and spaced vertically a preselected distance apart, a brace member of a preselected length adapted to move into and out of position extending between and connecting said leg members to rigidify said leg members in an erect position, said brace member including a unitary rigid bar of a preselected length connected to a selected one of said leg members, said bar being movable into connection with another one of said leg members to thereby maintain said frame in an erect position and to space said pairs of arm members a selected distance apart for supporting musical instruments in a position on the stand for playing the musical instruments, and said brace member being operable to rigidify said leg members in an erect position so that said respective pairs of arm members are spaced a preselected distance apart to position said support platforms to receive selected musical instruments and instrument accessories in a predetermined arrangement for playing of said instruments on the stand and to permit freedom of movement of said instruments to selected positions on the stand.

7. A music stand for supporting musical instruments and instrument accessories comprising, a frame including a plurality of leg members adapted to engage a floor and extend upwardly from the floor, said leg members being pivotally connected to permit movement of said leg members between a collapsed position and an erect position, a plurality of pairs of arm members connected to said respective leg members to form a plurality of support platforms, said pairs of arm members being movable with said leg members for movement between a position for supporting musical instruments when said leg members are erect and a collapsed position corresponding to the collapsed position to said leg members, said support platforms being positioned one above the other and spaced vertically a preselected distance apart, said leg members including a first pair of rectangularly constructed leg members and a second pair of rectangularly constructed leg members, said first and second pairs of leg members being positioned in spaced parallel relation, a brace member of a preselected length adapted to move into and out of position extending between and connecting said leg members to rigidify said leg members in an erect position, said brace member connecting said first and second pairs of leg members, said brace member being hinged to permit said frame to collapse by movement of said first and second pairs of leg members from an erect position spaced apart to a collapsed position closely adjacent, and said brace member being operable to rigidify said leg members in an erect position so that said respective pairs of arm members are spaced a preselected distance apart to position said support platforms to receive selected musical instruments and instrument accessories in a predetermined arrangement for playing of said instruments on the stand and to permit freedom of movement of said instruments to selected positions on the stand.

8. A music stand for supporting musical instruments and instrument accessories comprising, a frame including a plurality of leg members adapted to engage a floor and extend upwrdly from the floor, said leg members being pivotally connected to permit movement of said leg members between a collapsed position and an erect position, a plurality of pairs of arm members connected to said respective leg members to form a plurality of support platforms, said pairs of arm members being movable with said leg members for movement between a position for supporting musical instruments when said leg members are erect and a collapsed position corresponding to the collapsed position of said leg members, said support platforms being positioned one above the other and spaced vertically a preselected distance apart, said support platforms including pairs of said arm members positioned in horizontal, parallel spaced relationship, a first pair of said arm members being supported by said frame at an upper elevation, a second pair of said arm members being supported by said frame at an elevation below said first pair of arm members, a third pair of said arm members being supported by said frame at an elevation intermediate said first and second pairs of said arm members, a brace member of a preselected length adapted to move into and out of position extending between and connecting said leg members to rigidify said leg members in an erect position, and said brace member being operable to rigidify said leg members in an erect position so that said respective pairs of arm members are spaced a preselected distance apart to position said support platforms to receive selected musical instruments and instrument accessories in a predetermined arrangement for playing of said instruments on the stand and to permit freedom of movement of said instruments to selected positions on the stand.

9. A music stand as set forth in claim 8 which includes, a shelf positioned on each of said first, second and third pairs of said arm members, and said shelves being vertically spaced to provide a plurality of levels for supporting the musical instruments and instrument accessories in a preselected arrangement.

* * * * *